350-331 SR
XR 4,044,546

United St
Koike

[11] 4,044,546
[45] Aug. 30, 1977

[54] DIGITAL LIQUID CRYSTAL ELECTRONIC TIMEPIECE WITH COLOR CODED DISPLAY

[75] Inventor: Mitsuo Koike, Tokyo, Japan

[73] Assignee: Kabushiki Kaisha Daini Seikosha, Japan

[21] Appl. No.: 713,227

[22] Filed: Aug. 10, 1976

[30] Foreign Application Priority Data

Aug. 11, 1975 Japan ..... 50-97387

[51] Int. Cl.² ..... G04B 19/34
[52] U.S. Cl. ..... 58/50 R; 58/23 R; 350/160 LC
[58] Field of Search ..... 58/23 R, 50 R; 340/324 R, 336; 350/160 LC

[56] References Cited

U.S. PATENT DOCUMENTS 3,922,847 12/1975 Culley et al. ..... 58/50 R
3,956,880 5/1976 O'Connor ..... 58/50 R

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

Instead of having separate digital display means for seconds, minutes, hours, dates and months, an electronic timepiece uses the same liquid crystal display and differentiates between seconds, minutes, hours, dates and months by displaying each in a different color. This makes it possible to have the timepiece smaller and at the same time have the individual digits of the display larger and hence more easily legible. The different colors of the display are obtained by using a plurality of driving voltages for the liquid crystal display device and switching circuitry for applying the different drive voltages to the liquid crystal device according to whether seconds, minutes, hours, dates or months is to be displayed.

6 Claims, 6 Drawing Figures

FIG. 1
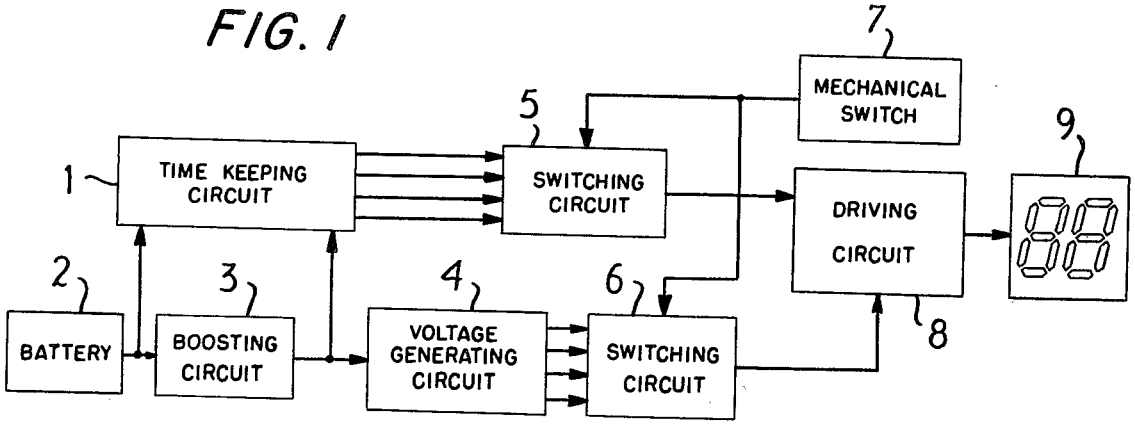
FIG. 2
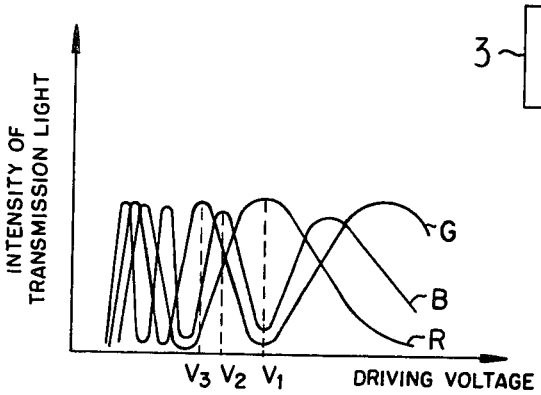
FIG. 3
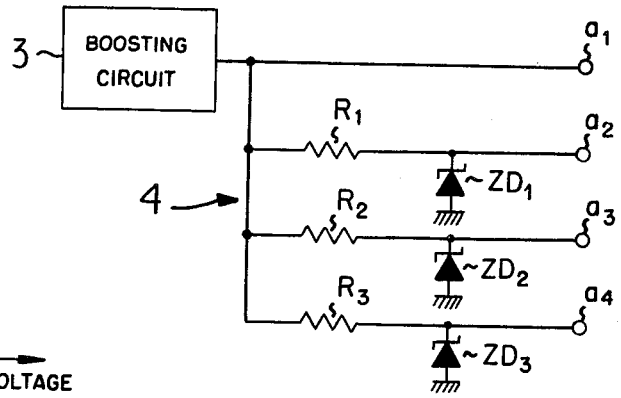
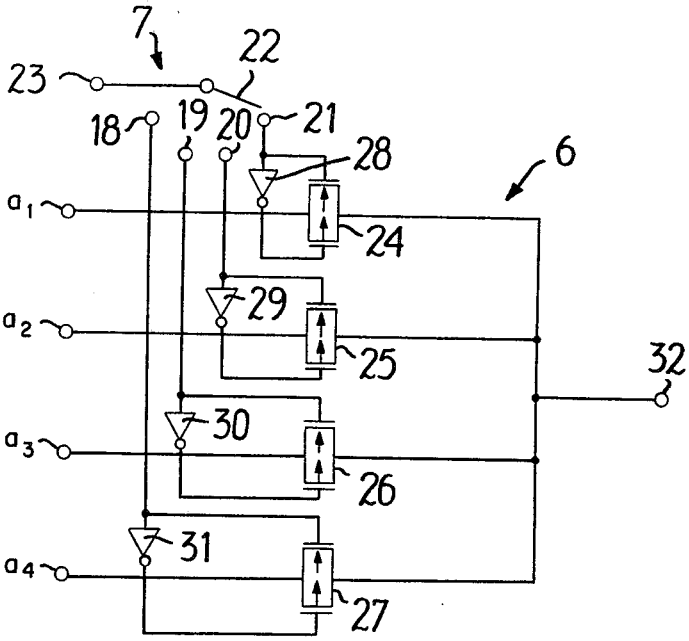
FIG. 5

DIGITAL LIQUID CRYSTAL ELECTRONIC TIMEPIECE WITH COLOR CODED DISPLAY

FIELD OF INVENTION

This invention relates to electronic digital timepieces and particularly to providing for a digital display of seconds, minutes, hours, dates and months on a display panel of small size.

BACKGROUND OF INVENTION

In the conventional electronic timepiece, if the values of seconds, minutes, hours, dates and months are to be displayed on a display panel, it is necessary to provide a display portion of two digits for seconds, a display portion of four digits for minutes and hours and a display portion of four digits for dates and months. It is thus necessary to provide a total of ten digits in the display device. If each of the digits is to be of a scale to be easily readable, the entire display panel becomes quite large. It is therefore very difficult to make a small wristwatch for women with such a display device. As a means of solving this problem, it has been proposed to provide a four digit display whereby a time unit of months and dates, a time unit of hours and minutes and a time unit of seconds are selectively displayed. This makes it possible to reduce the size of the display panel but it is difficult to recognize the time unit. Therefore, it is necessary to provide an additional circuit and additional display means for identifying the contents displayed. The mounting of such additional display has the disadvantage of its being impossible to see the display in perspective.

SUMMARY OF INVENTION

It is an object of the present invention to provide a small sized electronic wristwatch having a small sized digital display panel by reducing the number of digits and distinguishing the different time units from one another without the need of an additional display device for identifying the time units displayed. A further object of the invention is to provide a digital liquid crystal electronic timepiece having a simple display panel. In accordance with the invention there is provided a digital liquid crystal display device in which the time units of seconds, minutes, hours, dates and months are displayed respectively by different colors so that it is possible easily to distinguish the contents of the several time units.

The invention makes it possible to provide large size digits in the display panel even for a small watch by reducing the numbers of digits in the display and color coding the digital display so as to differentiate the time units of seconds, minutes, hours, dates and months from one another.

BRIEF DESCRIPTION OF DRAWINGS

The nature, objects and advantages of the invention will be more fully understood from the following description of a preferred embodiment shown by way of example in the accompanying drawings, in which:

FIG. 1 is a block diagram showing the circuitry and digital display device of an electronic timepiece in accordance with the present invention;

FIG. 2 is a diagram showing the characteristics for indicating a retardation effect of the liquid crystal display device;

FIG. 3 is a circuit diagram of the voltage generating circuit of FIG. 1;

FIG. 5 is a circuit diagram of the switching circuit of FIG. 1 for selecting the drive voltage of the liquid crystal display device.

DESCRIPTION OF PREFERRED EMBODIMENT

Figure 4:
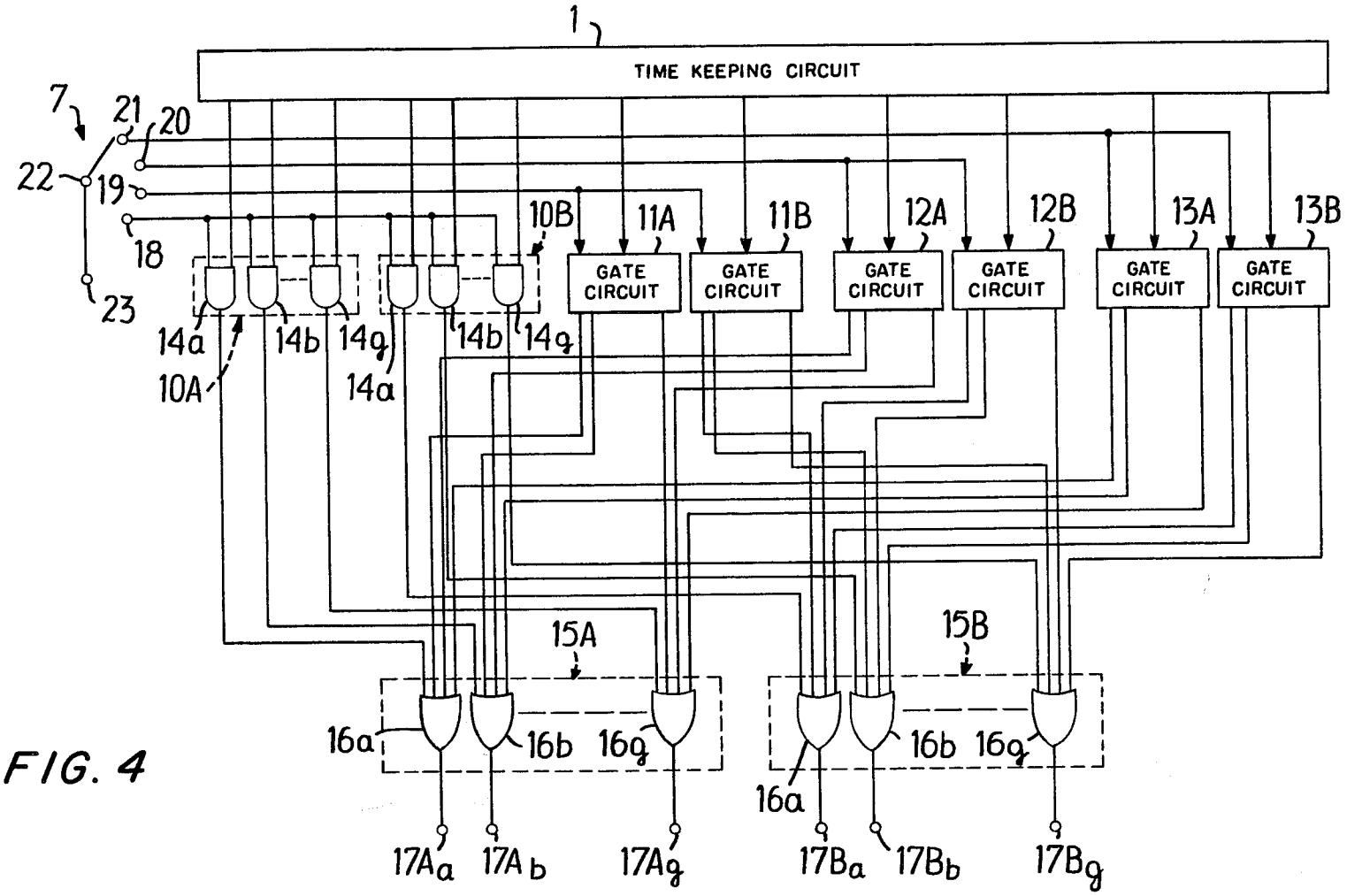
FIG. 4 is a circuit diagram of the switching circuit of FIG. 1 for selecting the display time signal.

FIG. 1 shows a block diagram of circuitry and a digital liquid crystal display device of an electronic timepiece in accordance with the invention. The circuitry comprises a time keeping circuit 1 which as is well known comprises an oscillating circuit having a quartz element, a dividing circuit for obtaining a standard signal of 1Hz, a time counter for counting the pulses of the standard signal to generate a time signal corresponding to the time units of seconds, minutes, hours, dates and months and a decoder for changing the output of the time counter to coded time signals. Thus, four kinds of time signals are generated by the time keeping circuit 1. The time keeping circuit 1 is operated by the output voltage of a boosting circuit 3 which is powered by a battery 2.

The circuitry as shown in FIG. 1 further includes a voltage generating circuit 4, one embodiment of which is shown in FIG. 3. As shown in this embodiment, the voltage generating circuit 4 has an input terminal connected to the voltage boosting circuit 3 and four output terminals $a_1$, $a_2$, $a_3$ and $a_4$. The terminal $a_1$ is connected directly to the input and hence supplies the boosted voltage of the boosting circuit 3. The terminal $a_2$ provides a selected voltage lower than the voltage of the boosting circuit 3 by reason of being connected to the input of the voltage generating circuit through a resistance $R_1$ and a zener diode $ZD_1$. The terminal $a_3$ provides a third voltage value which is lower than that of terminal $a_2$ by reason of being connected to the input through a resistance $R_2$ and zener diode $ZD_2$. Terminal $a_4$ supplies a voltage lower than that of terminal $a_3$ by reason of being connected to the input through a resistance $R_3$ and a zener diode $ZD_3$. Thus the voltage of terminal $a_1$ is equal to the boosted voltage of the boosting circuit 3. However, the output voltages of terminals $a_2$, $a_3$ and $a_4$ correspond to the output voltages of zener diodes $ZD_1$, $ZD_2$ and $ZD_3$ respectively. The resistance values of the resistors $R_1$, $R_2$ and $R_3$ determine the electric current supplied to the zener diodes $ZD_1$, $ZD_2$ and $ZD_3$ and are selected so as to generate certain voltages corresponding to the desired zener diode voltages supplied to the terminals $a_2$, $a_3$ and $a_4$.

With reference to FIG. 1, the time signals of minutes, hours, dates and months generated by the time keeping circuit 1 are applied to a switching circuit 5. The four voltages generated by the voltage generator 4 and appearing respectively at the terminals $a_1$, $a_2$, $a_3$ and $a_4$ are applied to a switching circuit 6. The switching circuits 5 and 6 are controlled by a mechanical switch 7 which is operated for example by operation of the stem of the electronic timepiece or other operational switching means. The switching circuit 5 selects one signal of minutes, hours, dates or months and applies it to a driving circuit 8. The switching circuit 6 selects one of the voltages generated by the voltage generating circuit 4 and applies it to the driving circuit 8. According to the present invention when the switching circuit 5 selects the time signal of months, the switching circuit 6 selects the voltage generated at the terminal $a_1$ of the voltage generating circuit 4. When the time signal of dates is selected by the switching circuit 5, the voltage of terminal $a_2$ is selected by the switching circuit 6. Further, when the time signal of hours is selected by the switching circuit 5, the voltage of terminal $a_3$ is selected by switching circuit 6 and when the time signal of minutes is selected by the switching circuit 5, the voltage of terminal $a_4$ is selected by the switching terminal 6.

The driving circuit 8 drives the liquid crystal display device 9 with the voltage selected by the switching circuit 6 when the time signal selected by the switching circuit 5 is to be displayed by the liquid crystal display device 9. The liquid crystal display device 9 is composed of two digit display portions, each of which has seven alpha-numeric type segment electrodes and one common figure electrode. The liquid crystal employed in the liquid display device 9 has a retardation effect whereby the color of the liquid crystal is changed by applying different drive voltages.

The retardation effect of the liquid crystal is illustrated in FIG. 2 in which the abscissa indicates the drive voltage being applied to the liquid crystal and the ordinates indicate the intensity of transmission light. The curves G, B and R indicate the change of intensity of transmission light corresponding to the change of drive voltage of green, blue and red. At the voltage $V_1$ the intensity of transmission light of red comes to a peak whereby the displayed color is red. At the voltage $V_2$ the intensity of transmission light of blue comes to a peak whereby the displayed color is blue. At the voltage $V_3$ the intensity of transmission light of green comes to a peak whereby the displayed color is green. If the liquid crystal is driven by voltage between $V_1$ and $V_2$ the displayed color becomes an intermediate color between red and blue, namely red-blue, purple and blue-purple. Therefore, the display color is easily changed by changing the drive voltage of the liquid crystal. When the time signal of minutes, hours, dates and months is selected, the drive voltage for the liquid crystal display device is selected by the switching circuit 6 according to the time signal to be displayed. When the time signal to be displayed by the liquid crystal device is changed, the display color is simultaneously changed so that the time units of months, dates, hours and minutes are identified and differentiated from one another by the display color.

A detailed embodiment of the switching circuit 5 of FIG. 1 is shown by way of example in FIG. 4 as comprising eight gate circuits 10A, 10B, 11A, 11B, 12A, 12B, 13A and 13B, each of which comprises seven AND circuits 14*a*, 14*b*–14*g*. The segment signals corresponding to the minute signal generated by the time keeping circuit 1 are applied to one input terminal of the AND circuits 14*a*–14*g* of the gate circuits 10A and 10B while the other input terminals of the AND circuits are commonly connected and connected to one stationary contact 18 of the mechanical switch 7. The segment signals corresponding to the hours signal generated by the time keeping unit 1 are applied to one input terminal of the AND circuits 14*a*–14*g* of the gate circuits 11A and 11B, while the other input terminals of the AND circuits are commonly connected and connected to a second stationary contact 19 of the mechanical switch 7. The segment signals corresponding to the date signal generated by the time keeping circuit 1 are applied to one input terminal of the AND circuits 14*a*–14*g* of the gate circuits 12A and 12B while the input terminals of the AND circuits are commonly connected and are connected to a third stationary contact 20 of the mechanical switch 7. The segment signals corresponding to the month signal generated by the the time keeping circuit 1 are applied respectively to one input terminal of the AND circuits 14*a*–14*g* of the gate circuits 13A and 13B while the other input terminals of the AND circuits are commonly connected and are conected to a fourth stationary contact 21 of the mechanical switch 7. The switch 7 has a movable contact 22 which selectively contacts the stationary contacts 18, 19, 20 and 21 and is connected to a terminal 23 to which is supplied a voltage level corresponding to the logic [1].

The outputs of the gate circuits 10A, 11A, 12A and 13A are applied to a gate circuit 15A. The outputs of the gate circuits 10B, 11B, 12B and 13B are applied to a gate circuit 15B. Each of the gate circuits 15A and 15B is composed for example of seven four-input OR circuits 16*a*–16*g*. The outputs of AND circuits 14*a*–14*g* of the gate circuits 10A, 11A, 12A and 13A are applied to the OR circuits 16*a*–16*g* of the gate circuit 15A. The outputs of AND circuits 14*a*–14*g* of the gate circuits 10B, 11B, 12B and 13B are applied to the OR circuits 16*a*–16*g* of the gate circuit 15B. The outputs of the OR circuits 16*a*–16*g* of the gate circuit 15A are connected to the terminals 17A*a*–17A*g* as output terminals of the switching circuit 5 and the outputs of OR circuits 16*a*–16*g* of the gate circuit 15B are connected to terminals 17B*a*–17B*g* as further output terminals of the switching circuit 5. According to the switching circuit 5 when the movable contact 22 of the mechanical switch 7 contacts the stationary contact 21, the segment signals corresponding to the time signal of months generated by the time keeping circuit 1 pass through the gate circuits 13A and 13B and further pass through gate circuits 15A and 15B and appear at the output terminals 17A*a*–17A*g* and 17B*a*–17B*g*. In the same manner when the movable contact 22 of the selector switch 7 is operated so as to contact the stationary contact 20, the segment signals corresponding to the dates signal pass through the gate circuits 12A and 12B and the gate circuits 15A and 15B and appear at the terminals 17A*a*–17A*g* and 17B*a*–17B*g*. When the movable contact 22 of the switch 7 is operated so as to contact the stationary contact 19, the segment signals corresponding to the hours signal pass through gate circuits 11A and 11B and through gate circuits 15A and 15B and appear in like manner at the output terminals of the switching circuit 5. When the movable contact 22 of the switch 7 is operated so as to contact the stationary contact 18, the segment signals corresponding to the minute signal pass through gate circuits 10A and 10B and through gate circuits 15A and 15B and appear at the output terminals of the switching circuit. As seen in FIG. 1, the output terminals of the switching circuit 5 are connected through the driving circuit 8 to the digital display device 9. Thus, according to the operation of the mechanical switch 7, the segment signals corresponding to the minutes, hours, dates and months signals respectively are selectively applied to the digital display device 9 by the switching circuit 5.

FIG. 5 shows one detailed embodiment of the switching circuit 6 of FIG. 1 as comprising four transmission gates 24, 25, 26 and 27 and four inverters 28, 29, 30 and 31 corresponding respectively to the transmission gates. The input terminals of the transmission gates 24, 25, 26 and 27 are respectively connected to the terminals $a_1$, $a_2$, $a_3$ and $a_4$ of the voltage generating circuit 4. The output terminals of the transmission gates 24, 25, 26 and 27 are commonly connected to a terminal 32 which is the output terminal of the switching circuit 6. One control terminal of each of the transmission gates 24, 25, 26 and 27 is connected respectively to the stationary terminals 18, 19, 20 and 21 of the mechanical switch 7 shown in FIG. 1 and 4 while the other control terminal of each of the transmission gates is connected to said switch contacts through inverters 28, 29, 30 and 31 respectively. The voltage supplied by the terminal $a_1$, namely the highest voltage being generated by the voltage generating circuit 4 is applied through the transmission gate 24 to the output terminal 32 of the switching circuit 7 when the movable contact 22 of the mechanical switch 7 contacts the stationary contact 21. When the mechanical switch 7 is operated so that the movable contact 22 contacts the stationary contact 20, the transmission gate 25 becomes "ON" whereby the voltage supplied by the terminal $a_2$ of the voltage generating circuit 4 appears at the output terminal 32. In like manner the voltages of terminals $a_3$ and $a_4$ appear at the output terminal 32 of the switching circuit 6 when the movable contact 22 of the switch 7 contacts stationary contacts 19 and 18 respectively. Thus the transmission gates 24, 25, 26 and 27 are respectively switched to ON position by the operation of the mechanical switch 7 whereby the four output voltages of the voltage generating circuit 4 selectively appear at the output terminal 32 which as seen in FIG. 1 is connected to the driving circuit 8 of the digital display device 9.

Figure 6:
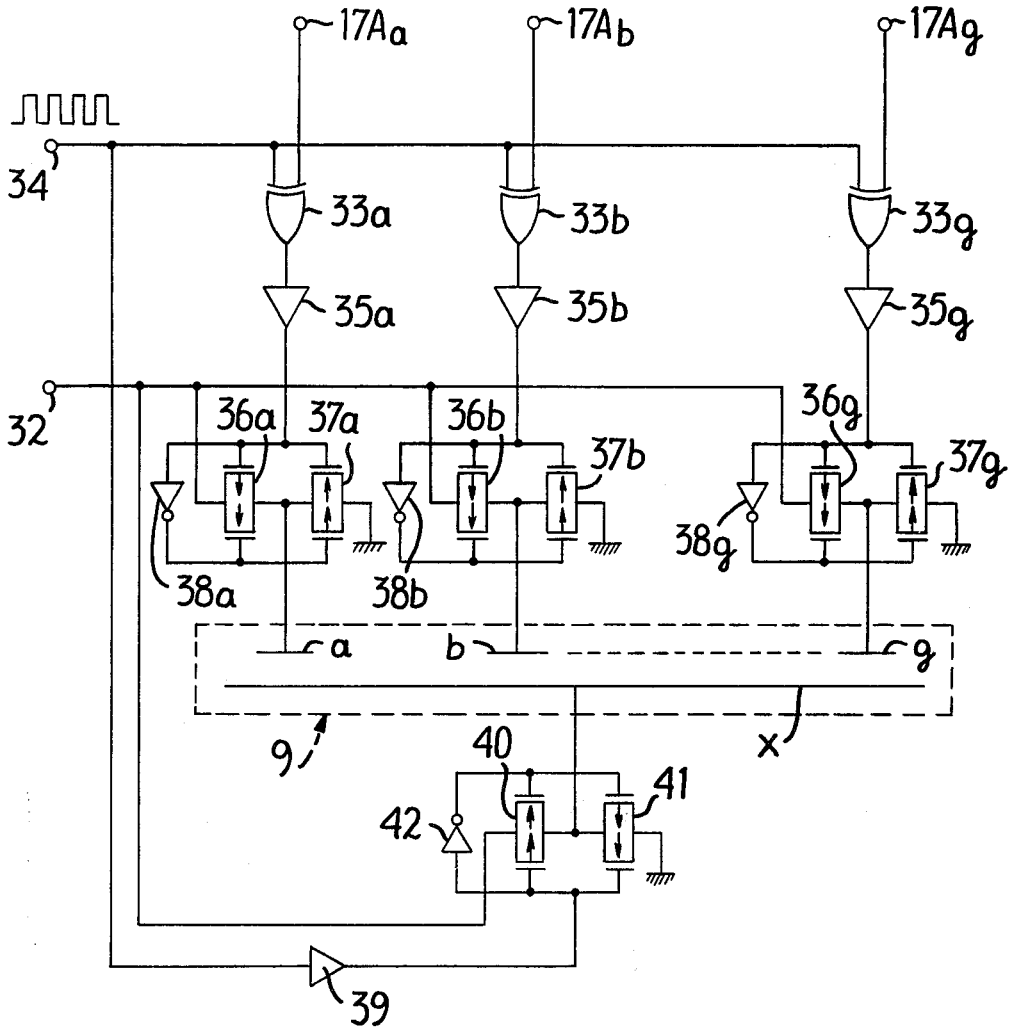
FIG. 6 is a circuit diagram of the drive circuit of FIG. 1.

FIG. 6 shows by way of example one detailed embodiment of the drive circuit 8 of FIG. 1, the same reference numerals being employed to identify the same parts in FIGS. 1, 3, 5 and 6. FIG. 6 shows only the drive circuit for one display portion of the liquid crystal display device 9, the drive circuit of the other display portion being of the same construction.

As shown in FIG. 6, the circuit comprises exclusive OR circuits 33*a*–33*g* to one input terminal of which the segment signals appearing at the output terminals 17A*a*–17A*g* of the switching circuit 5 are applied. A dividing signal of 32Hz obtained from the time keeping circuit 1 is applied through the common terminal 34 to the other input terminal of the exclusive OR circuits 33*a*–33*g.* The outputs of the exclusive OR circuits 33*a*–33*g* are amplified to the output voltage level of the terminal $a_1$ of the voltage generating circuit 4, namely the output voltage of the boosting circuit 3 by level shifters 35*a*–35*g* and are applied to one control terminal of a pair of transmission gates 36*a*–36*g* and 37*a*–37*g* and also to the other control terminal of said gates through inverters 38*a*–38*g.* The input terminals of the transmission gates 36*a*–36*g* are commonly connected to the terminal 32 of the switching circuit 6. The input terminals of transmission gates 37*a*–37*g* are connected to ground. The output terminals of transmission gates 36*a*–36*g* and 37*a*–37*g* are commonly connected and the common output of each pair are respectively connected to the segment electrodes *a*–*g* in one display portion of the liquid display device 9. The 32Hz dividing signal applied to the terminal 34 is amplified to the amplitude of the boosted voltage of the voltage boosting circuit 3 by a level shifter 39 and is applied to one control terminal of each of a pair of transmission gates 40 and 41 and is inverted by the inverter 42 and applied to the other control terminals. The input terminal of the transmission gate 40 is connected to the output terminal 32 of the voltage switching circuit 6 while the input terminal of transmission gate 41 is connected to 0-voltage level represented by ground. The output terminals of the pair of transmission gates 40 and 41 are commonly connected and are connected to the figure electrode X in one display portion of the liquid crystal display device 9.

According to the drive circuit 8, when the segment signal supplied from the terminal 17A*a* is of high level H and the dividing signal applied to the terminal 34 is of high level H, the outputs of the exclusive OR gate 33*a* and level shifter 35*a* are lower level L whereby the transmission gate 36*a* becomes to ON position whereby the output voltage from the terminal 32 is applied to the segment electrode *a.* When the dividing signal is at a high level the transmission gate 31 becomes to ON position whereby the voltage of the figure electrode X becomes 0. On the contrary, when the dividing signal becomes a lower level L, the transmission gate 37*a* becomes to ON position whereby the voltage level of the segment electrode *a* becomes 0 while the transmission gate 40 becomes to ON position whereby the voltage supplied by the terminal 32 is applied to the figure electrode X. Therefore, during the time that the segment signal of high level is generated, the output voltage of the terminal 32 is alternately applied to the segment electrode *a* and the figure electrode X in synchronism with the frequency of the driving signal supplied by the terminal 34 whereby the liquid crystal corresponding to the segment electrode *a* is alternately driven.

When the segment signal is not generated from the terminal 17A*a* and is at lower level L, the transmission gate 37*a* becomes to ON position when the dividing signal supplied to the terminal 34 is at the higher level H whereby the segment electrode *a* becomes to voltage level 0 as does also the figure electrode X. When the output voltage of the terminal 32 is applied to the segment electrode *a,* it is also applied to the figure electrode X by the transmission gate 36*a* which becomes to ON position when the dividing signal becomes to the lower level L. Therefore, there is no electric field between the segment electrode *a* and the figure electrode X whereby the liquid crystal corresponding to the segment electrode *a* is not driven. The above noted operation is similarly applied to the other segment electrodes *b-g.* In each instance, when the segment electrodes are driven, the drive voltage is the voltage from the terminal 32, namely one of the voltages from the terminals $a_1$, $a_2$, $a_3$ and $a_4$ of the voltage generating circuit 4 as selected by the switching circuit 6.

The liquid crystal display device 9 driven by the drive circuit 8 changes its display color according to the different drive voltages. In the present embodiment there are four different colors. Therefore, the time units of months, dates, hours and minutes are selectively displayed by the display device 9 and simultaneously the display colors are changed whereby it is possible easily to distinguish and recognize the contents of the displayed time by watching the displayed color.

In the present embodiment the time units of minutes, hours, months and dates are preferably selected and are displayed with different colors. It is possible also to display the time unit of seconds by providing an additional voltage generated from the voltage generating circuit 4. Further, it is possible to display the time units of months and dates by the same color or different colors by employing a four digit liquid crystal display device 9 and to display the time units of hours and minutes by the same color or different colors by employing a four digit type liquid crystal display device. In this case, the displayed contents of months-dates and hours-minutes are easily recognized.

The invention is in no way limited to the embodiment shown in the drawings and herein particularly described as it is possible to modify and improve the construction. For example, instead of the time signal being selected by the operation of the mechanical switch, it is possible cyclically to display the time signals by employing the dividing signal obtained from certain dividing steps of the time keeping circuit.

According to the present invention the time unit of seconds, minutes, hours, dates and months are preferably selected, the driving voltage of the liquid crystal display device being changed in response to the displayed time units. Further, the displayed color of the liquid crystal display is preferably changed by the retardation effect whereby the display portion of liquid crystal display device is simplified. It is thus possible in accordance with the present invention to easily recognize the displayed time display and to obtain a colorful display panel.

What I claim is:

1. An electronic timepiece with a digital liquid crystal display, comprising a time signal pulse generating circuit, a time counting circuit for generating time signals corresponding to seconds, minutes, hours and dates, liquid crystal display means having retardation effect for displaying a digital time signal in different colors according to the drive voltage applied, a first switching circuit means for selectively supplying different time signals from said time counting circuit to said display means for visual display thereby, a voltage generating circuit for generating a plurality of different drive voltages for driving said liquid cyrstal display means, and a second switching circuit means coordinated with said first switching circuit means to supply from said voltage generating circuit to said liquid crystal display means a selected drive voltage corresponding to the selected time signal to be displayed, whereby different time signals are distinguished from one another by being displayed in different colors.

2. An electronic timepiece according to claim 1, in which said liquid crystal display means consists of means for displaying two digits.

3. An electronic timepiece according to claim 1, comprising manually operable switch means jointly controlling said first switching circuit means and said second switching circuit means.

4. An electronic timepiece according to claim 1, comprising a driving circuit for driving said liquid crystal display means, said driving circuit having inputs connected respectively to said first switching circuit means and said second switching circuit means and outputs connected to said liquid crystal display means.

5. An electronic timepiece according to claim 2, in which said voltage generating circuit comprises means for generating four different drive voltages for said liquid crystal display means.

6. An electronic timepiece according to claim 5, in which said liquid crystal display means comprises segment electrodes and a figure electrode and in which said driving circuit comprises means controlled by voltage pulses supplied by said time signal pulse generating circuit for supplying a selected drive voltage alternately to said selected ones of said segment electrodes and said figure electrode to display a selected time signal in a selected color.

* * * * *